United States Patent [19]
Bankowski et al.
[11] 4,139,378
[45] Feb. 13, 1979

[54] POWDER-METALLURGY OF COBALT CONTAINING BRASS ALLOYS

[75] Inventors: Richard S. Bankowski, Whitehall; Kermit E. Geary, Walnut Port, both of Pa.

[73] Assignee: The New Jersey Zinc Company, Bethlehem, Pa.

[21] Appl. No.: 846,298

[22] Filed: Oct. 28, 1977

Related U.S. Application Data

[63] Continuation of Ser. No. 417,982, Nov. 21, 1973, abandoned.

[51] Int. Cl.² ..... B22F 7/00; C22C 9/04
[52] U.S. Cl. ..... 75/247; 75/153
[58] Field of Search ..... 75/153, 157.5, 0.5 R; 148/13.2, 11.5 C

[56] References Cited

U.S. PATENT DOCUMENTS

| | | | |
|---|---|---|---|
| 1,723,922 | 8/1929 | Corson | 75/153 |
| 2,126,827 | 8/1938 | Smith | 75/157.5 |
| 2,255,204 | 9/1941 | Best | 75/157.5 |
| 2,296,706 | 9/1942 | Corson | 75/157.5 |
| 2,368,943 | 2/1945 | Patterson | 29/182 |
| 2,813,785 | 11/1957 | Matsukawa | 75/0.5 R |
| 3,128,172 | 4/1964 | Wagner et al. | 75/0.5 B |
| 3,298,828 | 1/1967 | Thelin | 75/157.5 |
| 3,369,893 | 2/1968 | Opie et al. | 75/157.5 |
| 3,402,043 | 9/1968 | Smith | 75/157.5 |
| 3,615,922 | 10/1971 | Alyea | 75/157.5 |

OTHER PUBLICATIONS

The Philosophical Magazine, Ser. 7, vol. 43, #341, Jun. 1952, pp. 613, 614, 615, 618, 619 and 620.

*Primary Examiner*—L. Dewayne Rutledge
*Assistant Examiner*—Peter K. Skiff
*Attorney, Agent, or Firm*—Charles I. Sherman

[57] ABSTRACT

The properties of brass powder compacts are improved by including selected amounts of cobalt in the brass powder compositions; specifically brass powder compacts broadly comprising about 5% to about 45% zinc, about 1% to about 7% cobalt, balance essentially copper, are disclosed.

10 Claims, No Drawings

POWDER-METALLURGY OF COBALT CONTAINING BRASS ALLOYS

This is a continuation of application Ser. No. 417,982, filed Nov. 21, 1973, now abandoned.

BACKGROUND OF THE INVENTION

This invention relates to the powder-metallurgy of brass and in particular, it is concerned with brass powders of novel composition which, when processed by normal powder-metallurgy fabrication techniques, exhibit improved mechanical properties.

Brasses of various compositions are known to be readily adaptable to powder-metallurgical processing techniques. These brasses when produced as brass powders by air atomization or other known techniques and then compacted under pressures of 20–50 tons per square inch (tsi) and sintered at temperatures of 800°–950° C. develop commercially useful tensile properties. While conventional brass powders are firmly established commercially, the properties exhibited thereby are inferior to those obtained in comparable cast or wrought brasses. Consequently, brass powder-metallurgy parts are typically not used in highly stressed structural applications.

Increased strength and hardness of powder-metallurgy fabrications can be attained by increasing the compacting pressure, re-pressing and re-sintering, and/or increasing the sintering temperature. However, the upper limit of compacting pressure is normally considered to be about 50 tons per square inch, since any increase above this pressure substantially raises equipment and tooling costs. Increasing the sintering temperature beyond certain limits is not practicable because blistering may result from the pressure of entrapped gases. Similarly, changes in fabrication techniques are generally considered unacceptable in view of the higher costs involved.

Accordingly representative objects of the present invention are to provide improved brass powder-metallurgical compositions, compacts produced therefrom which exhibit improved mechanical properties, and methods of producing same, all of which are commercially useful and economically practicable.

Other objects of the invention will in part be obvious and will in part appear hereinafter.

The invention accordingly comprises the several steps and the relation of one or more of such steps with respect to each of the others, and the composition and product possessing the features, properties, and the relation of components, which are exemplified in the following detailed disclosure, and the scope of the invention will be indicated in the claims.

SUMMARY OF THE INVENTION

It has now been discovered that brass powders containing specially controlled amounts of cobalt, preferably prealloyed and atomized, exhibit marked improvements in physical and mechanical properties when formed into sintered compacts. These include increased ultimate tensile strengths, very substantial increases in yield strengths, increased hardness and a substantial decrease in shrinkage upon sintering. The improvement in yield strength is of particular importance in that for structural applications the design stress is the lower of $\frac{1}{4}$ of the ultimate tensile strength or $\frac{2}{3}$ of the yield strength, the latter generally being the limiting consideration.

The brass powders exhibiting these improved properties broadly consist essentially of the following components in the following ranges, all percentages being, as they are throughout the remaining specification and claims, percentages by weight; about 5% to about 45% zinc, about 1% to about 7% cobalt, the balance being essentially copper. As used herein in the specification and claims the terms "consisting essentially" and/or "balance essentially" are intended to encompass amounts of additives or impurities which do not materially affect the basic characteristics of the alloy. In this regard the brass powders and compacts of the invention may contain small amounts of lead of up to about 2%.

DESCRIPTION OF THE PREFERRED EMBODIMENTS

A series of brass powder compositions were prepared, in accordance with the invention, and the mechanical properties thereof determined and compared with conventional brass powders. The powders of the invention were produced from melts containing prealloyed cobalt by air atomization, and have the following Tyler sieve analysis which is typical of commercial production:

| | | |
|---|---|---|
| −60 | +80 Mesh - | 5% |
| −80 | +100 Mesh - | 5% |
| −100 | +200 Mesh - | 25% |
| −200 | +325 Mesh - | 20% |
| | −325 Mesh - | 45% |

The powders were then lubricated with 0.5% lithium stearate, compacted at 30 tsi, and sintered in a blended dissociated ammonia atmosphere at temperatures from 850° to 890° C. as hereinafter noted. The results of the mechanical property determinations are described in the following examples, and the correlative data presented in Tables 1 to 5.

EXAMPLE 1

Prealloyed cobalt additions over the range of about 1% cobalt to about 5% cobalt were made to a nominal 90% copper, 10% zinc (90/10) brass melt, and a powder made therefrom by air atomization. A comparison of the mechanical properties of the compacts thereof was made with the compact of an unleaded nominal 90/10 brass (Sample A1). The data are shown in the following Table 1:

Table 1

| Sample | A1 | B1 | C1* | D1 | E1 | F1 | G1 |
|---|---|---|---|---|---|---|---|
| Composition: | | | | | | | |
| Copper | 88.9 | 88.4 | 87.8 | 87.2 | 86.3 | 86.8 | 85.6 |
| Zinc | Bal. | 10.4 | 10.4 | 10.4 | 10.0 | 10.0 | 8.8 |
| Cobalt | 0 | 1.18 | 1.75 | 2.32 | 2.60 | 3.04 | 4.3 |
| Sintered Density, g/cc: | 7.92 | 7.90 | 7.87 | 7.87 | 7.94 | 7.90 | 7.64 |
| Ultimate Tensile Strength, psi: | 28,900 | 30,000 | 32,300 | 38,100 | 40,000 | 36,600 | 32,300 |
| Yield Strength, 0.2% Offset, psi: | 12,300 | 11,700 | 16,900 | 27,000 | 29,200 | 27,000 | 24,400 |
| Elongation, %: | 17 | 19 | 13 | 10 | 10 | 8 | 7 |

Table 1-continued

| Sample | A1 | B1 | C1* | D1 | E1 | F1 | G1 |
|---|---|---|---|---|---|---|---|
| Hardness, $R_H$: | 76 | 72 | 81 | 92 | 94 | 92 | 85 |
| Dimensional Change (from Die Size) %: | −0.78 | −0.56 | −0.57 | −0.57 | −0.70 | −0.62 | −0.50 |

*50/50 Blend of Adjacent Compositions
Sintering Conditions:
Preheat - 30 Minutes at 550° C.
Sinter - 30 Minutes at 890° C.

As shown in Table 1, even at the lowest cobalt level (about 1.18% — Sample B1), a 28% decrease in dimensional change is achieved upon sintering as compared to the cobalt-free compact (Sample A1). As the cobalt content approaches 1.75% (Sample C1) a significant improvement in strength and hardness properties is observed. The optimum mechanical properties are obtained from compositions containing about 2% to about 3% cobalt (e.g. about 2.6%—Sample E1). These optimum alloys compare with those of the cobalt-free 90/10 brass as follows:

(1) An increase of about 38% in ultimate tensile strength
(2) An increase of about 137% in yield strength (0.2% offset)
(3) An increase of about 18 points in hardness The decrease in elongation from about 17% from Sample A1 to about 10% for Sample E1 is acceptable for most commercial applications. The dimensional change on sintering is essentially unaffected by the addition of 2.6% cobalt. Similar mechanical properties would be achieved in a nominal 85% copper, 15% zinc (85/15) brass powder with similar cobalt additions.

EXAMPLE 2

A determination was made of the mechanical properties of nominal 80% copper, 20% zinc (80/20) brass powder compacts containing from about 1% to about 5% cobalt, with the results being shown in Table 2. A leaded 80/20 brass powder compact (Sample A2) was used for comparison because of the unavailability of a commercial unleaded 80/20 powder. Earlier tests with leaded and unleaded 70/30 brass powder compacts had shown, however, that lead has a negligible effect on mechanical properties.

Table 2

| Sample | A2 | B2 | C2* | D2 | E2 | F2 | G2 | H2 |
|---|---|---|---|---|---|---|---|---|
| Composition: | | | | | | | | |
| Copper | 78.6 | 78.6 | 77.9 | 77.3 | 80.0 | 77.4 | 75.9 | 75.8 |
| Zinc | Bal. | 19.0 | 18.9 | 18.8 | 16.0 | 19.1 | 20.0 | 18.0 |
| Cobalt | 0 | 1.46 | 1.83 | 2.20 | 2.68 | 3.44 | 4.10 | 4.22 |
| Lead | 1.47 | 0 | 0 | 0 | 0 | 0 | 0 | 0 |
| Sintered Density, g/cc: | 7.88 | 7.80 | 7.82 | 7.79 | 7.79 | 7.76 | 7.68 | 7.71 |
| Ultimate Tensile Strength, psi: | 33,200 | 36,900 | 39,600 | 42,000 | 42,600 | 39,400 | 38,800 | 39,100 |
| Yield Strength, 0.2% Offset, psi: | 13,300 | 17,700 | 23,200 | 27,800 | 31,400 | 26,600 | 26,900 | 27,500 |
| Elongation, %: | 28 | 20 | 16 | 12 | 8 | 11 | 8 | 9 |
| Hardness, $R_H$: | 78 | 86 | 92 | 94 | 96 | 94 | 93 | 94 |
| Dimensional Change (from Die Size) %: | −1.47 | −1.39 | −1.42 | −1.44 | −0.88 | −1.24 | −1.41 | −1.42 |

*50/50 Blend of Adjacent Compositions
Sintering Conditions:
Preheat - 30 Minutes at 550° C.
Sinter - 30 Minutes at 880° C.

As shown in Table 2, the addition of cobalt is most effective at about the 2% to about the 5% level (e.g. Sample E2), although improvements in mechanical properties are obtained over the entire range of compositions tested. The optimum cobalt addition of about 2.7% produced the following property improvements over those obtained with the leaded 80/20 brass compact used for comparison:

(1) An increase of about 28% in ultimate tensile strength
(2) An increase of about 136% in yield strength (0.2% offset)
(3) An increase of about 18 points in hardness, $R_H$
(4) Dimensional change (from die size) — about a 40% decrease in shrinkage.

While tensile elongation of Sample E2 decreased in comparison with Sample A2 from about 28% to about 8%, the latter value is still considered to be adequate for most commercial applications.

EXAMPLE 3

Investigations were conducted at various cobalt levels to determine the compositional range over which the addition of prealloyed cobalt has a beneficial effect on the properties of compacts made from leaded nominal 70% copper, 30% zinc (70/30) brass powder. The results are presented in Table 3. Also included are similar data obtained for a compact made from an unleaded nominal 70/30 brass powder containing about 2% to about 5% cobalt (e.g., 3.4% cobalt-Sample K3). Comparisons are made with compacts of commercial, lead-free and leaded 70/30 brass powders, respectively.

Table 3

| Sample | A3 | B3 | C3 | D3* | E3 | F3** | G3** | H3** |
|---|---|---|---|---|---|---|---|---|
| Composition: | | | | | | | | |
| Copper | 67.9 | 67.5 | 69.6 | 69.6 | 69.6 | 69.3 | 69.0 | 68.8 |
| Zinc | Bal. | Bal. | 27.2 | 27.0 | 26.8 | 26.9 | 27.0 | 27.2 |
| Cobalt | 0 | 0 | 1.7 | 1.9 | 2.1 | 2.3 | 2.5 | 2.7 |
| Lead | 0.20 | 1.67 | 1.45 | 1.46 | 1.48 | 1.44 | 1.41 | 1.38 |
| Sintered Density, g/cc: | 7.71 | 7.84 | 7.83 | 7.76 | 7.73 | 7.76 | 7.72 | 7.72 |

Table 4-continued

| Sample | A4 | B4 | C4* | D4 | E4 | F4* | G4 |
|---|---|---|---|---|---|---|---|
| Yield Strength, 0.2% Offset, psi: | 18,100 | 15,500 | 16,000 | 21,000 | 30,700 | 36,400 | 34,100 |
| Elongation, % | 24 | 34 | 27 | 15 | 6 | 4 | 3 |
| Hardness, $R_H$: | 98 | 92 | 86 | 88 | >100 ($R_E$ 82) | 99 | 97 |
| Dimensional Change (from Die Size), %: | −6.03 | −4.36 | −2.56 | −1.68 | −3.58 | −2.13 | −1.68 |

*50/50 Blend of Adjacent Compositions
Sintering Conditions:
Preheat - 30 Minutes at 550° C.
Sinter - 30 Minutes at 850° C.

As shown in Table 4, when cobalt is added to 60/40 brass powder the ultimate tensile strength is reduced somewhat, but it is still generally superior to that obtained in compacts made from conventional α brass powders. Yield strength at the optimum cobalt level of about 3% to about 7% (e.g., 4.95%—Sample F4) reaches 36,400 psi, an increase of 101% over the cobalt-free 60/40 powder. Hardness is substantially unchanged by addition of 4.95% cobalt while the elongation is decreased from 24% to 4% and dimensional change is reduced about 65%, from −6.03% to −2.13%. The addition of cobalt to 60/40 brass powder has a beneficial effect on one or more properties of the sintered compacts made therefrom at every level of cobalt addition investigated, that is about 1.18% to about 5.7% cobalt. In addition, the greater green strength evidenced in the compacts by additions of cobalt at all levels is most desirable in the fabrication of structural parts.

The properties obtained in compacts containing optimum cobalt concentrations, relative to those obtained in corresponding cobalt-free compacts, are summarized in Table 5:

Table 5

| Nominal Brass Powder Composition (unleaded): | 90/10 | | 80/20 | | 70/30 | | 60/40 | |
|---|---|---|---|---|---|---|---|---|
| Cobalt Content, %: | 0 | 2.6 | 0* | 2.7 | 0 | 3.4 | 0** | 4.95 |
| Sintered Density, g/cc: | 7.92 | 7.94 | 7.88 | 7.79 | 7.71 | 7.74 | 7.86 | 7.45 |
| Ultimate Tensile Strength, psi: | 28,900 | 40,000 | 33,200 | 42,600 | 33,400 | 46,100 | 49,900 | 44,200 |
| Yield Strength, 0.2% Offset, psi: | 12,300 | 29,200 | 13,300 | 31,400 | 9,400 | 37,000 | 18,100 | 36,400 |
| Elongation, %: | 17 | 10 | 28 | 8 | 33 | 6 | 24 | 4 |
| Hardness, $R_H$: | 76 | 94 | 78 | 96 | 75 | >100 ($R_E$ 80) | 98 | 99 |
| Dimensional Change (from Die Size), %: | −0.78 | −0.70 | −1.47 | −0.88 | −2.67 | −1.49 | −6.03 | −2.13 |

*Contained 1.47% Pb.
**Contained 1.55% Pb.

As shown in Table 5, yield strengths of over 29,000 to 37,000 psi can be attained, which constitute improvements of about 100% to about 300% as compared with compacts made from the corresponding cobalt-free powders. This increased yield strength permits brass powder compacts containing cobalt to be used in applications which require appreciably higher design stresses than those made from conventional brass powders are able to withstand. There are also substantial increases in ultimate tensile strength and hardness (except with 60/40 brass) which can only be duplicated in compacts made from cobalt-free brass powders through an uneconomic re-pressing and re-sintering operation.

The reduced dimensional change achieved on sintering cobalt-containing 70/30, 80/20 and 90/10 brass powder compacts is beneficial since it affords a greater degree of interchangeability and the flexibility to meet shrinkage requirements. In the case of 60/40 brass compacts, however, the addition of cobalt in accordance with the invention so greatly reduces dimensional change upon sintering as compared to the cobalt-free compacts, that fabricators can process the alloy in a manner similar to other brass powders.

As would be expected, ductility is reduced considerably at the higher yield strengths achieved by optimum cobalt additions. However, the elongation values obtained are adequate for most commercial applications. If higher elongations are required than are achieved at optimum cobalt levels, they can be obtained with some sacrifice of strength properties by modifying the cobalt content as indicated in Tables 1 to 4.

It will thus be seen that the objects set forth above, among those made apparent from the preceding description, are efficiently attained and, since certain changes may be made in carrying out the above process and in the article and product set forth without departing from the scope of the invention, it is intended that all matter obtained in the above description shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Having described our invention, what we claim as new and desire to secure by Letters Patent is:

1. A sintered brass compact containing cobalt and exhibiting substantially decreased shrinkage upon sintering in the order of at least about 40% improvement as compared to a comparable non-cobalt containing brass compact, and formed from a powder composition consisting essentially of about 25% to about 45% zinc, about 2% to about 7% cobalt, the balance being essentially copper.

2. A sintered brass compact as defined in claim 1 containing zinc in amounts of about 25% to about 35%, and cobalt in amount of about 2% to about 5%.

3. A sintered brass compact as defined in claim 1 containing zinc in amounts of about 26.8% to about 29.4%, and cobalt in amounts of about 2% to about 3.8%.

Table 3-continued

| | | | | | | | | |
|---|---|---|---|---|---|---|---|---|
| Ultimate Tensile Strength, psi: | 33,400 | 34,100 | 33,800 | 33,600 | 33,800 | 36,700 | 38,400 | 41,200 |
| Yield Strength, 0.2% Offset, psi: | 9,400 | 11,700 | 13,000 | 12,800 | 14,000 | 17,200 | 23,200 | 27,900 |
| Elongation, %: | 33 | 29 | 28 | 27 | 25 | 22 | 18 | 15 |
| Hardness, $R_H$: | 75 | 78 | 78 | 79 | 78 | 81 | 87 | 91 |
| Dimensional Change (from Die Size), %: | −2.67 | −3.29 | −2.05 | −1.51 | −1.43 | −1.41 | −1.46 | −1.52 |

| Sample | 13 | J3 | K3 | L3*** | M3*** | N3 | O3**** |
|---|---|---|---|---|---|---|---|
| Composition: | | | | | | | |
| Copper | 68.5 | 67.4 | 67.2 | 67.4 | 67.5 | 67.5 | 67.9 |
| Zinc | 27.3 | 27.8 | 29.4 | 27.6 | 27.4 | 27.2 | Bal. |
| Cobalt | 2.9 | 3.2 | 3.4 | 3.4 | 3.6 | 3.8 | 0 |
| Lead | 1.34 | 1.52 | 0.02 | 1.47 | 1.42 | 1.38 | 0.20 |
| Sintered Density, g/cc: | 7.72 | 7.68 | 7.74 | 7.69 | 7.65 | 7.66 | 8.01 |
| Ultimate Tensile Strength, psi: | 44,800 | 46,600 | 46,100 | 47,400 | 47,400 | 47,000 | 43,300 |
| Yield Strength, 0.2% Offset, psi: | 31,200 | 33,200 | 37,000 | 35,500 | 35,900 | 36,400 | 13,200 |
| Elongation, % | 12 | 10 | 6 | 8 | 7 | 7 | 44 |
| Hardness, $R_H$: | 94 | 100 | >100 ($R_E$ 80) | 100 | 99 | 100 | 98 |
| Dimensional Change (from Die Size), %: | −1.63 | −1.94 | −1.49 | −1.90 | −1.93 | −1.97 | |

*Blend of Adjacent Compositions
**Blend of Samples E3 and I3
***Blend of Samples J3 and N3
****Repressed and Resintered. The compacting and repressing pressures were 34 tsi.
Sintering Conditions:
Preheat - 30 Minutes at 550° C.
Sinter - 30 Minutes at 880° C.

These data set forth in Table 3 show that about 1.7% cobalt in leaded 70/30 brass (Sample C3) is effective in reducing the dimensional change on sintering by about 38%, from −3.29 to −2.05%. A significant increase in yield strength is evident at about the 2.1% cobalt level (Sample E3). Optimum properties are obtained in the range from about 2.9% to about 3.8% cobalt (Samples 13–N3). At the 3.4% cobalt level, the following property improvements occur as compared respectively with compacts of leaded and unleaded cobalt-free powders:

| | Leaded 70/30 | Unleaded 70/30 |
|---|---|---|
| Ultimate Tensile Strength | an increase of about 39% | an increase of about 38% |
| Yield Strength (0.2% Offset) | an increase of about 203% | an increase of about 294% |
| Hardness | an increase of about 22 points | an increase of about 27 points |
| Dimensional Change (from Die Size) | about a 42% decrease in shrinkage | about a 44% decrease in shrinkage |

The expected and acceptable decrease in elongation is noted upon addition of 3.4% cobalt: from about 29% to about 8% for the leaded powder compacts and from about 33% to about 6% for the unleaded variety.

EXAMPLE 4

The effects produced by the addition of varying amounts of cobalt to compacts made from nominal 60% copper, 40% zinc (60/40) brass powders differ in several respects from those obtained in compacts made from brass powders having higher copper contents and discussed hereinabove.

A conventional 60/40 brass has a mixed $\alpha + \beta$ crystal structure which, because of its greater hardness, affords considerably less compressibility in a powder form than $\alpha$ brass. As a result, a lower green density is achieved in compacts made with 60/40 brass powders as compared with $\alpha$ brass powders compacted at the same pressure, and the densification that normally occurs on sintering produces a shrinkage in excess of 6%, or about twice that of compacts of conventional brass powders. The densification is probably assisted by a complete transformation to the $\beta$ phase at sintering temperatures above 770° C., with the mixed $\alpha + \beta$ structure again appearing upon cooling to room temperature. Sintering below the transformation temperature is not effective since it does not afford sufficient bonding to develop optimum mechanical properties.

The addition of cobalt, however, apparently suppresses formation of the $\beta$ phase. Accordingly, greater compressibility resulting in denser green compacts can be achieved. In addition, metallographic examination of sintered compacts made from cobalt containing 60/40 brass powders shows that the $\beta$ phase transformation does not occur at the 850° C. sintering temperature. As a result, the sintering shrinkage is advantageously reduced to a point more in line with that normally encountered in $\alpha$ brass powder metallurgy. These and other mechanical effects of cobalt addition are evidenced by the data set forth in the following Table 4:

Table 4

| Sample | A4 | B4 | C4* | D4 | E4 | F4* | G4 |
|---|---|---|---|---|---|---|---|
| Composition: | | | | | | | |
| Copper | 59.2 | 60.3 | 62.0 | 63.6 | 58.8 | 59.6 | 60.4 |
| Zinc | Bal. | 38.2 | 35.1 | 32.0 | 37.0 | 35.4 | 33.7 |
| Cobalt | 0 | 1.18 | 2.3 | 3.4 | 4.2 | 4.95 | 5.7 |
| Lead | 1.55 | 0 | 0 | 0 | 0 | 0 | 0 |
| Compact Density, g/cc: | | | | | | | |
| Green | 6.64 | 7.20 | 7.26 | 7.25 | 7.03 | 7.11 | 7.14 |
| Sintered | 7.86 | 7.92 | 7.76 | 7.54 | 7.69 | 7.45 | 7.41 |
| Green Strength, psi: | 687 | 1060 | — | 978 | 1006 | — | 1133 |
| Ultimate Tensile Strength, psi: | 49,900 | 47,800 | 41,900 | 36,000 | 43,200 | 44,200 | 40,100 |

4. A sintered brass compact as defined in claim 3 containing cobalt in an amount of about 2.9% to about 3.8%.

5. A sintered brass compact as defined in claim 4 containing cobalt in an amount of about 3.4%.

6. A sintered brass compact as defined in claim 1 containing zinc in amounts of about 35% to about 45%, and cobalt in amounts of about 2% to about 7%.

7. A sintered brass compact as defined in claim 6 containing cobalt in an amount of about 3% to about 7%.

8. A sintered brass compact as defined in claim 1 containing zinc in amounts of about 32% to about 38.2%, and cobalt in amounts of about 2% to about 5.7%.

9. A sintered brass compact as defined in claim 16 containing cobalt in an amount of about 4.95%.

10. A sintered brass compact as defined in claim 1 containing lead in an amount of up to about 2%.

* * * * *

UNITED STATES PATENT AND TRADEMARK OFFICE

CERTIFICATE OF CORRECTION

PATENT NO. : 4,139,378

DATED : February 13, 1979

INVENTOR(S) : Richard S. Bankowski and Kermit E. Geary

It is certified that error appears in the above-identified patent and that said Letters Patent are hereby corrected as shown below:

In the Abstract of the Disclosure, add the following sentence to the end thereof:

> In particular, substantially decreased shrinkage upon sintering (as compared to comparable non-cobalt containing brass compacts) is noted in compacts consisting essentially of about 25% to about 45% zinc, about 2% to about 7% cobalt, the balance being essentially copper.

In claim 9 line 1 delete "16" and insert therefor --8--

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*